United States Patent [19]

Hutchings

[11] B 3,992,283

[45] Nov. 16, 1976

[54] HYDROCRACKING PROCESS FOR THE MAXIMIZATION OF AN IMPROVED VISCOSITY LUBE OIL

[75] Inventor: LeRoi E. Hutchings, Mount Prospect, Ill.

[73] Assignee: Universal Oil Products Company, Des Plaines, Ill.

[22] Filed: Sept. 23, 1974

[21] Appl. No.: 508,118

[44] Published under the second Trial Voluntary Protest Program on February 17, 1976 as document No. B 508,118.

[52] U.S. Cl. ..... 208/59; 208/18; 208/111; 252/458; 252/477 R

[51] Int. Cl.[2] ..... C10G 41/00; C10G 13/06; C10G 37/02

[58] Field of Search ..... 208/59, 18

[56] References Cited

UNITED STATES PATENTS

| | | | |
|---|---|---|---|
| 3,308,055 | 3/1967 | Kozlowski | 208/111 |
| 3,444,071 | 5/1969 | Langhout | 208/59 |
| 3,463,724 | 8/1969 | Langlois et al. | 208/98 |
| 3,530,061 | 9/1970 | Orkin et al. | 208/60 |
| 3,562,149 | 2/1971 | Bryson et al. | 208/143 |
| 3,617,482 | 11/1971 | Egan | 208/59 |
| 3,617,484 | 11/1971 | Thompson et al. | 208/59 |
| 3,732,156 | 5/1973 | Bennett et al. | 208/111 |
| 3,793,191 | 2/1974 | Billon et al. | 208/59 |

*Primary Examiner*—Delbert E. Gantz
*Assistant Examiner*—G. E. Schmitkons
*Attorney, Agent, or Firm*—James R. Hoatson, Jr.; Thomas K. McBride; William H. Page, II

[57] ABSTRACT

A process for hydrocracking petroleum fractions to produce lubricating oils of suitable viscosity index comprising subjecting a petroleum fraction to hydrocracking conditions selected to minimize the formation of non-lube oil fractions in the presence of a first hydrocracking catalyst, fractionating the resulting hydrocracked lube oil stock into a plurality of fractions having different boiling ranges, subjecting a higher boiling fraction to hydrocracking conditions in the presence of a second hydrocracking catalyst and blending the resulting lube oil fractions to produce the lube oil base stocks of the desired viscosity and viscosity index.

5 Claims, No Drawings

HYDROCRACKING PROCESS FOR THE MAXIMIZATION OF AN IMPROVED VISCOSITY LUBE OIL

The present invention relates to the art of petroleum refining or processing and, more particularly, to the production of lubricating oils of suitable viscosity index. Still more particularly, the present invention is directed to a process for treating a lube oil hydrocracker charge whereby the lube oil base stocks produced have a high quality and are produced in greater yields than are obtained when subjecting the total lube oil hydrocracker charge stock to hydrocracking conditions for a time and temperature commensurate with the production of lube oil base stocks of the desired viscosity or the desired viscosity index.

In the art of petroleum refining, a particularly desired lubricating oil product is one which possesses a high viscosity index (V.I.). This is in order that the oil will perform at a high degree of efficacy at the varying degrees of temperature to which it is subjected in use. There has been an ever-increasing demand for high V.I. oils, and there is a decreasing amount of natural sources from which said oils may be readily obtained. Accordingly, it is desirous that the industry discover ways of manufacturing these materials from those sources which are available. It is fortuitous for the industry that recent developments in the art of hydrocracking of petroleum fractions (principally catalysts) constitute major technical advances resulting in a hydrocracking technique for the manufacture of high V.I. lube oils, a commercially feasible route to these desired oils. While these developments provide a commercially feasible technique for producing these oils, it is nevertheless not only possible but also desirable to achieve greater efficiencies as well as higher quality of the lube oil so produced. The present discovery provides a desirable and, in fact, commendable improvement in the manufacture of high V.I. oils by hydrocracking.

It has now been found that if a lube oil hydrocracking charge is subjected to hydrocracking conditions selected to minimize the formation of non-lube oil fractions and the product is separated into a plurality of fractions having different boiling ranges and a higher boiling range fraction is again subjected to hydrocracking conditions, the yields and quality of the hydrocracked lube product is substantially enhanced.

Typically, lube oil hydrocracking processes use a relatively heavy charge stock containing a large amount of polycyclic compounds such as the naphthenes and aromatics in addition to the desirable lube oil components. Typical charge stocks are unpressed vacuum distillates, deasphalted reduced crudes, pressed and unpressed deasphalted residuums, all usually boiling above about 650°F. While not wishing to be bound by any theories set forth herein, it is believed that those theories advanced heretofore by others are correct as to the mechanism involved in hydrocracking enhancement of the V.I. of such lube oil fractions. These theories postulate that the V.I. increase has been in large part due to ring-scission of the polycyclic compounds in said materials, but with minimal cleavage of said compounds into lower molecular weight materials. Notwithstanding the fact that ring-scission plays an important part in the accomplishment of V.I. enhancement, it has been observed that certain types of ring compounds have an apparent adverse effect in the hydrocracking. It is believed that the bad actors responsible for the adverse effect are some form of polyfused-ring aromatic compounds. Unless pretreated, for example, by solvent extraction or deasphalting before hydrocracking, the heavier fractions become progressively worse in term of yields as well as quality of the high V.I. product as the molecular weight, boiling point, and amount of the polyfused-ring aromatics content increase therein.

This can be explained as follows: The hydrocracker feedstock is invariably a complex mixture of compounds as indeed any petroleum fraction is, and the heavier fractions invariably comprise a mixture of polyfused-ring compounds of various types. Certain of these polyfused-ring compounds are easier to break than others. Hydrocracking operating conditions are quite naturally adjusted to the particular feed and based on the results obtained therewith. The greater the amount of hydrocracking refractory materials present, the more operating conditions tend to be adjusted upward, the temperature in particular. In making such adjustments in operating conditions, certainly more of the refractory materials are caused to break and open up into aliphatic substituents on a remaining ring(s). However, at the same time that this occurs, some components in the feed that are more easily hydrocracked (generally the polyfused-ring naphthenics) are overcracked at the more strenuous conditions required and employed to open up greater amounts of the more refractory material in admixture therewith. This overcracked material reduces lube yield because a large portion of it will be too light for inclusion in lube fractions. On the other hand, if the operating conditions are based on the predominant conversion of non-refractory materials present, the refractory materials present will be undercracked and, accordingly, offset the good V.I. material produced by the ring-scission of the non-refractory components. It has been observed that generally the amount of overcracking of the easier-to-crack materials exceeds the amount of ring-opening of the more refractory materials, thereby decreasing the overall yield of desired high V.I. lube product in severe operations. Of course, some overcracking results in cleavage of molecules into less valuable low molecular weight products such as gasolines.

The present invention can be carried out by subjecting a lube oil charge stock to hydrocracking conditions selected to minimize the formation of non-lube oil fractions in the presence of a first hydrocracking catalyst, fractionating the resulting hydrocracked lube oil stock into a plurality of fractions having different boiling ranges, subjecting a higher boiling fraction to hydrocracking conditions in the presence of a second hydrocracking catalyst and recovering the resulting lube oil fractions.

The lower boiling unrefined lube oil hydrocracking charge stock which contains the least amount of the refractory components, i.e., polyfused-ring aromatics, is charged together with the heavy charge stock to the first hydrocracking catalyst. The hydrocracking conditions of the first catalyst are selected to achieve some V.I. improvement of the lower boiling charge stock without overcracking which results in cleavage of molecules into less valuable low molecular weight products. In this first catalyst zone, the heavy portion of the charge stock undergoes some V.I. improvement but its full potential for V.I. enhancement is not realized until later.

The effluent from the first catalyst zone comprises a partially improved lower boiling range lube oil and a higher boiling range lube oil of too high a viscosity. After separation, the higher boiling range lube oil is charged to the second catalyst zone at operating conditions selected to reduce the viscosity and improve the V.I. characteristics to the extent required for the final blend. The operating conditions of the second catalyst zone are preferably more severe than those in the first catalyst zone since the higher boiling charge stock contains refractory components which must be successfully converted before full V.I. improvement is achieved. The overall volume yield of lube oil is maintained at a high level because the more easily cracked components of the original lube oil charge are never exposed to the severe hydrocracking conditions necessary to convert the more refractory fractions. The oils produced in the second zone are recovered and blended with the oils produced in the first zone to obtain exactly the viscosity and viscosity index desired.

The catalyst compositions may be the same or different in the first and second catalyst zones with the composition selected dependent on the charge stock to be passed over same and the known characteristics of the particular catalyst composition. Any lube oil hydrocracking catalyst suitable for the manufacture of high V.I. lubes can be employed; however, generally preferred catalysts are sulfides of a Group VI-B metal, of the periodic system, mixed with a Group VIII metal. Most preferably, the catalyst is a mixture of nickel sulfide and molybdenum sulfide in a 1/1 to 1/5 metal ion ratio.

The temperatures employed can be the same throughout the catalyst zone or different but, in general, will be in the range of from about 600°F. to about 900°F.

The partial pressure of hydrogen should be at least about 1500 psi. and more usually above about 2000 psi. to about 4000 psi., although hydrogen partial pressure as high as about 10,000 psi. can be employed.

There is, of course, always some sacrifice in yield at the expense of increase in V.I. in any hydrocracking operation because of cleavage-cracking. However, in the embodiments of the present invention, lube oil yield is maximized and considerable flexibility in terms of product distribution of desired viscosity stocks with a high V.I. is provided by reason of the cleave-cracking phenomena.

The following examples are given to further illustrate the process of the present invention and to indicate the benefits to be afforded through the utilization thereof. It is understood that the examples are given for the sole purpose of illustrating a method for the practice of the present invention and that the examples are not intended to limit the generally broad scope and spirit of the appended claims.

EXAMPLE A

A suitable deasphalted oil having an initial boiling point of 850°F. and a specific gravity of 20.4° API is selected to produce a high viscosity index lubricating oil with a high yield. The deasphalted oil is charged along with hydrogen to a first catalytic reaction zone containing 1/16-inch spherical silica-alumina catalyst comprising 2 weight percent nickel and 16 weight percent molybdenum and maintained at a pressure of 2400 psig. with a hydrogen circulation rate of 9000 SCFB and a reactor inlet temperature of 750°F.

Recovery, dewaxing and fractionation of the effluent from the reaction zone yields 55 barrels of dewaxed 95 V.I. lube oil of 350 SUS at 100°F. viscosity for every 100 barrels of deasphalted oil charged.

EXAMPLE B

A suitable deasphalted oil having an initial boiling point of 850°F. and a specific gravity of 20.4° API is selected to produce a high viscosity index lubricating oil with a high yield. The deasphalted oil is charged along with hydrogen to a first catalytic reaction zone containing 1/16-inch spherical silica-alumina catalyst comprising 2 weight percent nickel and 16 weight percent molybdenum and maintained at a pressure of 2400 psig. with a hydrogen circulation rate of 9000 SCFB and a reactor inlet temperature of 770°F.

Recovery, dewaxing and fractionation of the effluent from the reaction zone yields 60 barrels of dewaxed 100 V.I. lube oil of 300 SUS at 100°F. viscosity for every 100 barrels of deasphalted oil charged.

EXAMPLE C

A suitable deasphalted oil having an initial boiling point of 850°F. and a specific gravity of 20.4° API is selected to produce a high viscosity index lubricating oil with a high yield. The deasphalted oil is charged along with hydrogen to a first catalytic reaction zone containing 1/16-inch spherical silica-alumina catalyst comprising 2 weight percent nickel and 16 weight percent molybdenum and maintained at a pressure of 2400 psig. with a hydrogen circulation rate of 9000 SCFB and a reactor inlet temperature of 730°F. The temperature for the first catalytic reaction zone is selected to minimize the formation of non-lube oil fractions while at the same time improveing the viscosity index of the lower boiling range lube oil and partially improving the higher boiling range lube oil. The portion of the hydrocarbon effluent from the first catalytic reaction zone boiling above 925°F. is separated and then charged together with hydrogen to a second catalytic reaction zone containing 1/16-inch spherical silica-alumina catalyst comprising 2 weight percent nickel and 16 weight percent molybdenum and maintained at a pressure of 2300 psig. with a hydrogen circulation rate of 9000 SCFB and a reactor inlet temperature of 740°F.

Recovery, dewaxing and fractionation of the effluent from both catalytic reaction zones yields 65 barrels of dewaxed 95 V.I. lube oil of 300 SUS at 100°F. viscosity for every 100 barrels of deasphalted oil charged. Additionally, the oxidation stability of the oil is improved because some of the natural inhibitors which are present in the charge are still present in the lube oil fraction recovered from the first reaction zone.

The foregoing specification and examples clearly illustrate the improvements encompassed by the present invention and the benefits to be afforded a process for the maximization of the yield of lube oil produced from a hydrocracked charge stock.

I claim as my invention:

1. A process of hydrocracking lube oil stocks to high viscosity index oils comprising subjecting a lube oil charge stock to hydrocracking conditions selected to minimize the formation of non-lube oil fractions in the presence of a first hydrocracking catalyst, fractionating the resulting hydrocracked lube oil stock to separate therefrom a light lube oil boiling below about 925° F. and a heavier lube oil boiling above about 925° F., subjecting said heavier lube oil in the presence of a second hydrocracking catalyst to more severe hydrocracking conditions than said charge stock to reduce the viscosity and improve the V.I. characteristics of the heavier lube oil, blending the thus improved heavier lube oil with said light lube oil, and recovering the resultant lube oil blend as the product of the process.

2. The process of claim 1 further characterized in that said lube oil charge stock is an unpressed vacuum distillate, a deasphalted reduced crude, a pressed deasphalted residuum, an unpressed deasphalted residuum, or blends thereof.

3. The process of claim 1 further characterized in that said hydrocracking conditions include a temperature from about 600°F. to about 900°F. and a hydrogen partial pressure of from about 1500 psig. to about 4000 psig.

4. The process of claim 1 further characterized in that said first hydrocracking catalyst is a spherical silica-alumina catalyst comprising 2 weight percent nickel and 16 weight percent molybdenum.

5. The process of claim 1 further characterized in that said second hydrocracking catalyst is a spherical silica-alumina catalyst comprising 2 weight percent nickel and 16 weight percent molybdenum.

* * * * *